US007560670B2

(12) United States Patent
Lorenzen et al.

(10) Patent No.: US 7,560,670 B2
(45) Date of Patent: Jul. 14, 2009

(54) HEATING ELEMENT WITH A PLURALITY OF HEATING SECTIONS

(75) Inventors: Guenter Lorenzen, Olching (DE); Michael Weiss, Benediktbeuren (DE)

(73) Assignee: W.E.T. Automotive Systems AG (DE)

( * ) Notice: Subject to any disclaimer, the term of this patent is extended or adjusted under 35 U.S.C. 154(b) by 481 days.

(21) Appl. No.: 11/194,710

(22) Filed: Aug. 1, 2005

(65) Prior Publication Data

US 2006/0175049 A1 Aug. 10, 2006

(30) Foreign Application Priority Data

Jul. 30, 2004 (DE) ..... 10 2004 037 410

(51) Int. Cl.
*H05B 3/34* (2006.01)
*F28F 9/02* (2006.01)

(52) U.S. Cl. ..... 219/528; 219/529; 219/211; 219/212; 219/552; 219/553; 219/538; 219/202; 219/217; 219/541; 219/542; 219/545; 219/549; 165/158; 29/611

(58) Field of Classification Search ..... 219/211–212, 219/528–9, 552–3, 538, 202, 217, 541–542, 219/545, 549; 165/158; 29/611
See application file for complete search history.

(56) References Cited

U.S. PATENT DOCUMENTS 4,201,218 A * 5/1980 Feldman et al. ..... 607/112
5,824,996 A * 10/1998 Kochman et al. ..... 219/529
6,531,687 B2 3/2003 Michelmann

FOREIGN PATENT DOCUMENTS

DE 41 01 290 A1 7/1992

* cited by examiner

*Primary Examiner*—Shawntina Fuqua
(74) *Attorney, Agent, or Firm*—Thomas E. Donohue; Dickinson Wright PLLC

(57) ABSTRACT

A heating element (1) featuring at least two electrodes (5, 5') for supplying the heating element (1) with current, containing a multitude of heating sections (11, 11', 11") that, coating at least one part of a base surface to be heated (4), are arranged between the electrodes (5, 5') and are connected with them by electrical conduction. The heating element (1) has at least two bundles (9, 9', 9", 9") of heating sections (11, 11', 11"), with the bundles (9, 9', 9") being arranged at a distance from one another to avoid electrical contact between the bundles.

21 Claims, 2 Drawing Sheets

HEATING ELEMENT WITH A PLURALITY OF HEATING SECTIONS

TECHNICAL FIELD

The present invention relates to heating elements which are used, for example, in heating vehicle seats. In particular, the present invention concerns heating elements having at least two electrodes and containing a plurality of heating sections arranged between the electrodes.

BACKGROUND OF THE INVENTION

From DE 41 01 290 a heating element is known in which a multitude of heating conductors which are spaced apart and do not touch each other are arranged between two electrodes. One disadvantage of this type of design is that when there is a break in a heating conductor, the part of the base surface to be heated that is coated by this heating conductor can no longer be heated. It is particularly undesirable if the heating element is to be sewn in, because a large number of heating conductors can be damaged by the sewing needle.

From U.S. Pat. No. 6,531,687, a heating element is known in which a multitude of heating conductors connected with one another are laid between two electrodes. When there is a break in a heating conductor, the cross-linking of the heating conductors with one another leads to a deviation of the current around the location of the break. Consequently, despite a break in a heating conductor, this heating element will continue to heat the base surface to be heated in a substantially uniform manner. However, a difficulty arises in that when an electrode breaks, unwanted concentrations of current can occur at the location of the break in the electrode precisely due to the cross-linking of the heating conductors with one another. As a result, overheating or "hot spots" can occur in this area.

SUMMARY OF THE INVENTION

In order to attain a heating element that is less prone to failure, safer in terms of indirect damage and, moreover, can be overstitched more easily, an improved heating element is disclosed. The heating element includes at least two electrodes. A plurality of heating sections are arranged between the electrodes. The heating sections cover at least part of a base surface to be heated. The heating sections are arranged in bundles, such that each bundle includes a plurality of heating sections. The bundles are arranged at a distance from each other to avoid electrical contact between the bundles. Dividing heating sections into different bundles that do not contact each other electrically, insures sufficient redundancy with respect to failures of an individual heating section. Further, the design provides that uncontrolled current conduction in the event of an electrode break cannot result in local overheating.

A bundle is not defined here as merely a concentration of individual sections into an elongated general configuration with an approximately circular cross section. A bundle of heating sections is defined herein as a number of heating sections that are arranged within an, at least imaginary, physically definable elongated area, which can be regarded as functionally or physically related; or, at least with respect to their overall progression, which are arranged roughly lengthways to each other.

A heating element containing a bundle of at least three heating sections is advantageous in that it guarantees that the bundle will remain conductive even if an upholstery needle strike destroys or damages a cross point of two heating sections.

In one embodiment, at least one bundle is at least proportionately formed from copper, carbon particles, carbon fibers, carbonized synthetic filaments, silver, gold, polyamide or combinations of these; or one heating section includes one or several monofilament heating conductors, one or several layers of insulation or one or several mechanical reinforcing devices, where these component parts are arranged in a parallel, concentric, zigzag-meandering or spiral shape to the direction in which the heating section runs. A heating element according to these embodiment features robust, functional heating sections.

In another embodiment, at least one bundle features a tape-like strip within which the heating sections are arranged, preferably lengthways to each other. Such an embodiment avoids thick bundles of heating conductors protruding through or being tactily noticeable within upholstery.

In a further embodiment, at least two heating sections of a bundle which are spaced apart from one another, at least for the substantial majority of their course, are arranged in the bundle and at least one heating section features a multitude of bends or kinks, in order to form with at least one other heating section, a multitude of electrical junction points. At the junctions, the heating sections involved are connected with one another by electrical conduction, and are substantially distributed over the entire length of the bundle and/or the heating section, but at least in front of and behind (in relation to the direction of travel of the heating section) one stitching seam crossing or penetrating the heating bundle. This embodiment features bundles of heating conductors that can be overstitched very easily and that are fail-safe.

A heating element is also disclosed wherein the overall height is only two or three heating sections such the overall height is not noticeable through upholstery materials. In other words, it lies relatively flat such that it is not readily tactily detectible to a person in the vehicle seat.

A heating element having at least two heating sections with different materials or structures makes it possible to create configurations with differing redundancies or properties.

In yet another embodiment, the heating element features a carrier layer such as a textile material with at least one bundle stuck onto the carrier layer or laminated in between the carrier layer and a covering layer. At least one electrode can also be attached to the carrier layer by gluing, sewing on, knitting in, stitch-bonding and/or embroidering. A heating element according to this embodiment can be manufactured economically.

In a still further embodiment, the heating element in the area of the base surface to be heated can be at least partly overstitched by a stitching seam. The stitching seam can cross at least one bundle of heating sections at an angle ($\alpha$). The through-points of the stitches of the stitching seam can have an opening size (d) and gaps (x) from one another. The bundle has a width (b) crossways to its longitudinal extension; and in the plane of the base surface to be heated, at least one heating section of the bundle has a width (f) crossways to its longitudinal extension; and in the plane of the base surface to be heated, the opening size (d) is smaller than the width (b) of the bundle. The distances (x) of the through-points from one another are at least as great as the width (f) of the heating section. The opening size (d) of the penetration points of the stitches of the stitching seam can also be smaller than the width (b) of the heating bundle at least by the width (f) of a heating section (11). Also, the gaps (x) of the through points from one another can be at least as great as the width (b) of the bundle. A heating element according to these embodiments is particularly fail-safe despite overstitching.

Other objects and advantages will become apparent with reference to the following detailed description, taken in conjunction with the accompanying drawings.

BRIEF DESCRIPTION OF THE DRAWINGS

For a more complete understanding of this invention reference should now be made to the embodiments illustrated in greater detail in the accompanying figures and described below by way of examples of the invention wherein.

DETAILED DESCRIPTION OF THE INVENTION

Figure 1:
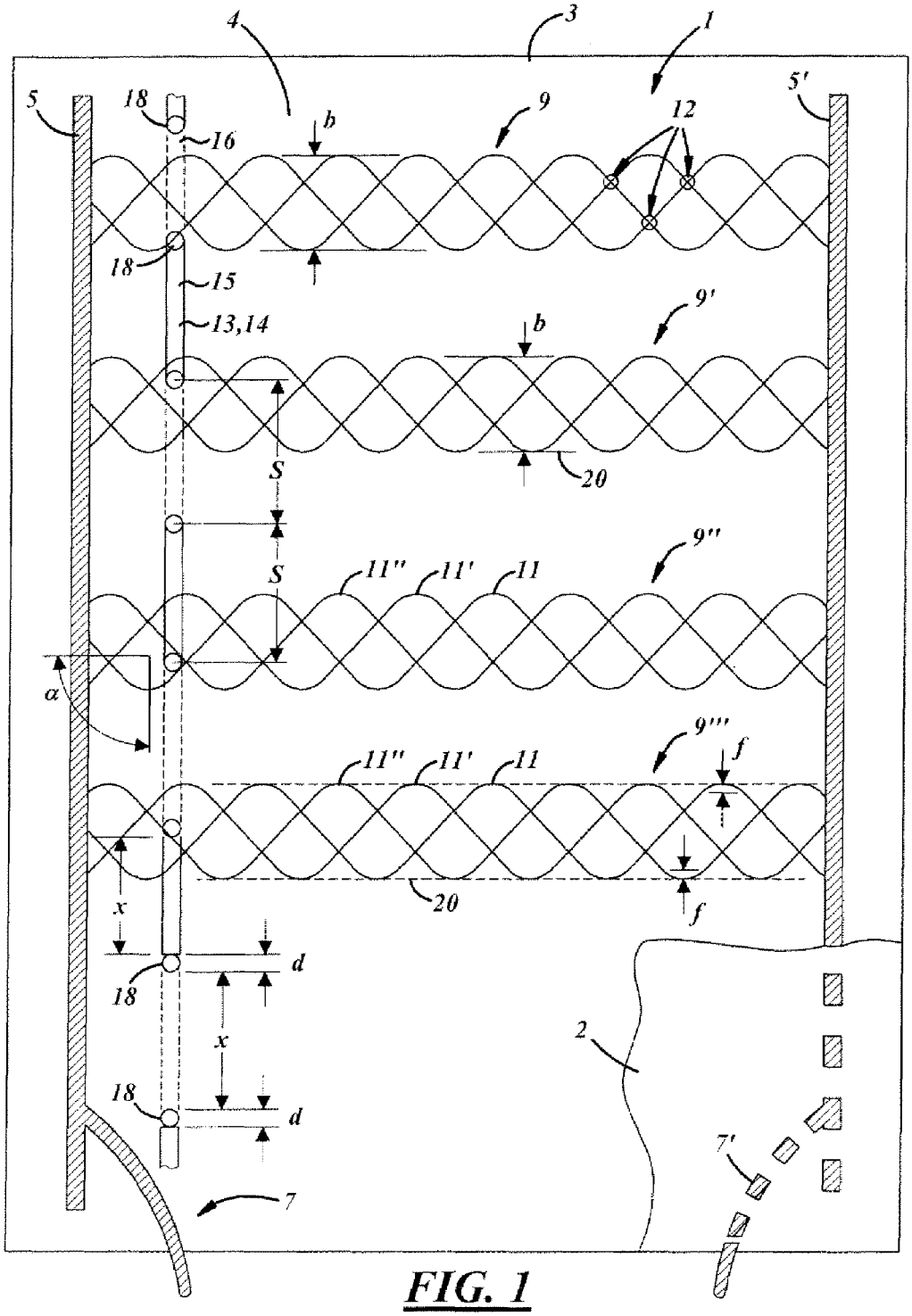
FIG. 1 shows a schematic diagram of one embodiment of an electrical heating element according to the present invention.

In the following figures, the same reference numerals are used to refer to the same components. While the present invention is described as a heating element for use within a vehicle seating system, it may be adapted and applied to various systems including steering wheel systems or other vehicle or non-vehicle systems requiring a heated surface. In this regard, in the following description, various operating parameters and components are described for several constructed embodiments. These specific parameters and components are included as examples only and are not meant to be limiting.

FIG. 1 shows one example of a heating element 1 according to the present invention. This example features a carrier layer 3. The carrier layer 3 can be manufactured from a textile material such as a knitted fabric or a felt material. In the present case it has rectangular dimensions. Two electrodes 5, 5' are arranged along the longitudinal edges of the carrier layer 3. The electrodes are formed, for example, from electrically conductive threads, electrically conductive bonding agents, electrically conductive foils and combinations of these items or similar known items.

The electrodes 5, 5' are each connected at one of their ends via an electrical supply lead 7, 7' to a power source (not shown) such as a current or voltage source.

Bundles 9, 9', 9", 9'" of heating sections 11, 11', 11" run at an angle ($\alpha$) to the electrodes. In the present case, only four bundles are shown, each having three heating sections. Of course, more bundles could be used, and more or fewer heating sections per bundle may be used depending upon the application under consideration. Bundles could also have different numbers of heating sections. The heating sections can be made of the same or different materials, even within a given bundle. The bundles 9, 9', 9", 9'" are arranged vertically to the electrodes 5, 5'. They are arranged on the carrier layer 3. They can be attached to the carrier layer with adhesive. However, they can also be laid on, stitched or, for example, woven on.

In the present example, the individual bundles 9, 9', 9", 9'" of heating sections 11, 11', 11" run in a straight line from one electrode 5 to the other electrode 5'. However, they can also be run in a meandering, crooked or other manner.

The bundles 9, 9', 9", 9'" of heating sections 11, 11', 11" do not touch each other. Conveniently, allowance is made for a sufficient number of bundles 9, 9', 9", 9'" in order to heat evenly a base surface to be heated 4 that is provided between the electrodes 5, 5'.

The bundles 9, 9', 9", 9'" can be at least proportionately formed from copper, carbon particles, carbon fibers, carbonized synthetic filaments, silver, gold, polyamide or combinations of these; or one heating section includes one or several monofilament heating conductors, one or several layers of insulation or one or several mechanical reinforcing devices, where these component parts are arranged in a parallel, concentric, zigzag-meandering or spiral shape to the direction in which the heating section runs. A heating element according to these embodiment features robust, functional heating sections.

The bundles 9, 9', 9", 9'" of heating sections 11, 11', 11" can be arranged in meandering fashion on or inside a tape-like strip 20. The strip 20 can be formed by a material underlay, an adhesive tape or similar. However, it can also be a purely imaginary demarcation of the space in which the heating sections 11, 11', 11" of a heating bundle 9, 9', 9", 9'" are arranged.

The heating sections 11, 11', 11" could also be laid in zigzag form, in a straight line or in another way. It is advantageous to space them out, at least for the most part. It is also advisable for at least one of the heating sections 11 to be arranged in such a way that it crosses a large number of other heating sections 11', 11" and thus creates junction points 12 to the other heating sections 11', 11".

In the present case, the heating sections 11, 11', 11" of a bundle 9, 9', 9", 9'" are laid in a wave or sine shape with exactly the same "amplitude" and an identical center line. They are staggered against each other by the proportion (one to their number in the bundle (here three)) of a "wave" along the central axis in the bundle.

To fix the entire configuration it may be advisable, as in the example design shown, to arrange a covering layer 2 on the carrier layer 3 in such a way that the electrodes 5, 5' and the heating sections 11, 11', 11" are embedded between them.

If the heating element is connected to current, current flows from the supply device via the supply lead 7 into the electrode 5. As the electrode 5 is clearly more conductive than the heating sections 11, 11', 11" the heating current is distributed evenly to the bundles 9, 9', 9", 9'" of heating conductors 11, 11', 11" connected to the electrode. The current then flows from the electrode 5 through the heating sections 11, 11', 11" of the base surface to be heated 4 into the electrode 5' and from there via the supply lead 7' back into the electricity/voltage point.

As shown in the sample design, it may be advisable to stitch the heating element 1 into a cover. In such case a stitching seam 13, for example, then runs over the base surface to be heated 4. The course of the stitching seam can be arranged at any angle desired a in relation to the course of the bundles of heating conductors 9, 9', 9", 9'" In the present case the stitching seam 13 runs vertically to the bundles 9, 9', 9", 9'" and roughly parallel to the electrodes 5, 5'. The stitching seam 13 features at least one stitched thread 14. The stitching seam 13 runs, following the needle stitches, to penetration points 18. The opening size (d) of the through-points 18 is essentially determined by the thickness of the sewing needles and/or the thickness of the stitched thread/the stitched threads. The length (s) of the needle stitches is measured from mid-point to mid-point of the through-points 18. The distance between the edges of the through-points is (x). In practice, due to the small size of the opening of the through point, (x) is essentially equivalent to the stitch length (s).

In order, when overstitching, to ensure current conduction through a bundle 9, 9', 9", 9'", it is necessary that during overstitching at least one heating section 11, 11', 11" is preserved. The current can then be transferred from damaged heating conductors to the remaining heating conductors. To achieve this, the junction points 12 should be arranged in relation to the direction in which the heating sections are running in front of and behind the stitching seam 13. Moreover, the junction points 12 should have a gap between them that is larger than the opening size (d) of the through-points 18. This prevents a large number of contact conductors from being able to be destroyed by a single strike from a needle. The same purpose is served if, for each junction point, only two heating sections 11, 11' intersect, and at least one remaining heating section 11" features a minimum distance from such a junction point that is at least as big as the opening size (d) of a through-point 18.

To prevent the sewing needle from striking a bundle 9, 9', 9", 9'" several times, it is advisable to opt for the distance (x) of the through-points 18 from one another to be at least as large as the width (f) of a heating section 11, 11', 11"; preferably as big as the width (b) of the bundle 9, 9', 9", 9'". This applies to an approximately right-angled overstitching of the bundle 9 by the stitching seam 13. If it is crossed over at another angle, the distance x of the through points 18 from one another is preferably at least the product of the width b of the conductor bundle and the sine of the chosen angle $\alpha$.

In an alternative type of design, not shown, provision can be made for a bundle of heating sections to be penetrated several times by through points of the stitches of a sewing needle. In this case, the number of heating sections and their arrangement is dispersed within the bundle in such a way that, despite the bundle being penetrated several times in the area of the bundle between the through points, the existence of a sufficient number of remaining heating sections is guaranteed.

A heating element 1 according to the present invention has numerous applications. For example, referring now to FIG. 2, a perspective and block diagrammatic view of a vehicle seat 50 incorporating a heating element 1 according to an embodiment of the present invention is shown. The heating element 1 is electrically coupled to a controller 52 including a power source 54 by way of a connector which may be a supply lead 7, 7' as described in more detail above. In this example, electrical power is transferred to the heating element 1 to warm an upper surface 56 of the seat cushion 57 of the seat 50. Of course, another heating element 1 could also be incorporated into the backrest 58 to similarly warm that portion of the seat 50 as well. As shown, the heating element 1 is contained within a seat cover 30 and is beneath and near the upper surface 56 to provide efficient transfer of thermal energy from the heating element 1 to the upper surface 56. The heating element 1 could also be incorporated into other portions of the seat cushion, and the seat system 50 could also include a fan or blower 60 electrically coupled to the controller 52 for directing air across the heating element 1 towards the upper surface 56. A similar arrangement could also be included in the backrest 58.

Figure 2:
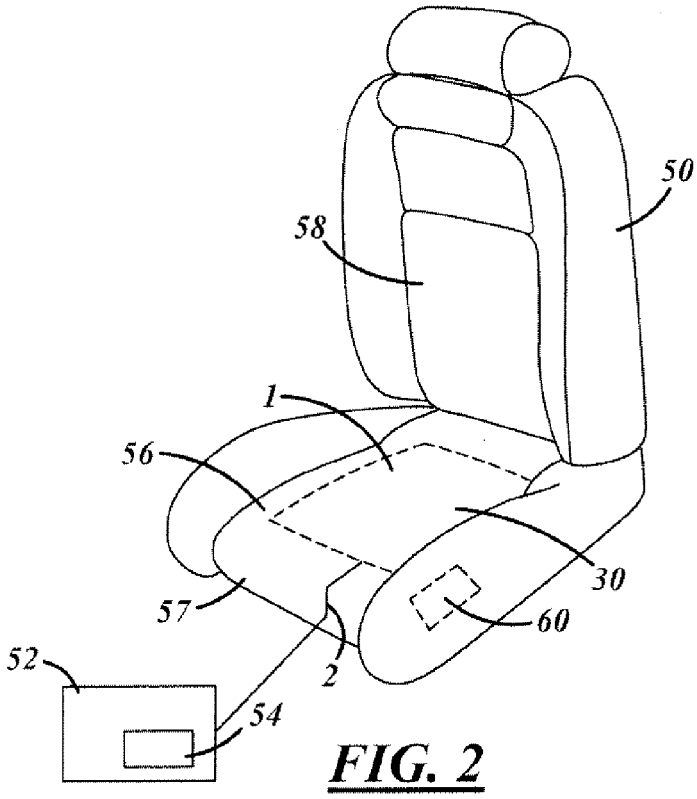
FIG. 2 is a perspective and block diagrammatic view of a vehicle seat incorporating a heating element according to an embodiment of the present invention.
Figure 3:
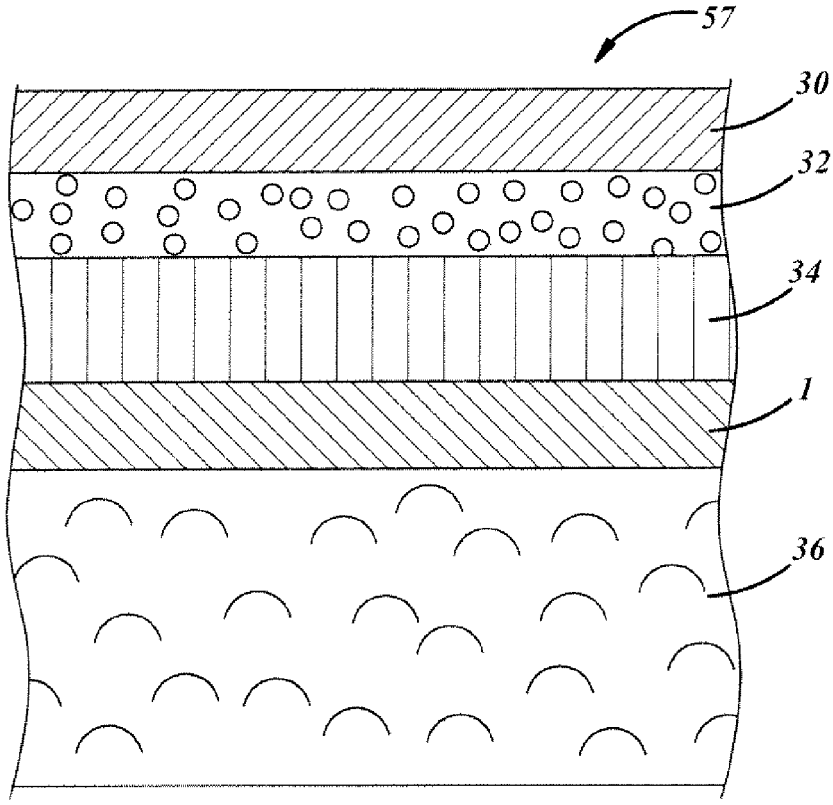
FIG. 3 shows a portion of a cross-section of a vehicle seat cushion incorporating a heating element according to the present invention.

FIG. 2 shows a portion of a cross-section of a seat cushion 57 incorporating a heating element 1 according to the present invention. The heating element 1 is integrated in the upholstery of the seat. In this case, the heating element 1 is arranged on a core pad 36. The core pad 36 is generally of foam material. The core pad can be either cast or foam. The heating element 1 is covered with an intermediate padding 34, a so-called "foam backing" 32 arranged over the intermediate padding 34, and a covering material 30. The covering material 30 is usually fabric or leather, and may be perforated to aid in conveying air toward, or away from, the passenger. A heating element so arranged will heat surfaces in contact with a user rapidly and with low energy outlay.

While the invention has been described in connection with one or more embodiments, it is to be understood that the specific mechanisms and techniques which have been described are merely illustrative of the principles of the invention, numerous modifications may be made to the apparatus described without departing from the spirit and scope of the invention as defined by the appended claims.

What is claimed is:

1. A heating element comprising:

at least two electrodes, and at least two bundles of heating sections, each bundle being electrically connected between two of said electrodes, wherein adjacent bundles are arranged at a distance from each other so as to avoid electrical contact, wherein each bundle comprises a plurality of heating sections arranged on at least a portion of a base surface to be heated;

wherein at least two heating sections of at least one bundle are spaced apart from one another for substantially a majority of their course, and at least one heating section forms a plurality of junction points with at least one other heating section.

2. A heating element comprising: at least two electrodes, and at least two bundles of heating sections, each bundle being electrically connected between two of said electrodes, wherein adjacent bundles are arranged at a distance from each other so as to avoid electrical contact, wherein each bundle comprises a plurality of heating sections arranged on at least a portion of a base surface to be heated;

wherein at least one bundle comprises at least three heating sections.

3. A heating element according to claim 1 wherein at least one bundle comprises at least one of copper, carbon particles, carbon fibers, carbonized synthetic filaments, silver, gold, polyamide.

4. A heating element comprising:

at least two electrodes, and at least two bundles of heating sections, each bundle being electrically connected between two of said electrodes, wherein adjacent bundles are arranged at a distance from each other so as to avoid electrical contact, wherein each bundle comprises a plurality of heating sections arranged on at least a portion of a base surface to be heated;

wherein at least one heating section comprises at least one of a plurality of monofilament heating conductors, an insulating layer, and a mechanical reinforcing device.

5. A heating element according to claim 1 wherein the heating sections are arranged in parallel, concentric, zig-zag-meandering or spiral shapes in the direction in which the heating sections run.

6. A heating element according to claim 4 wherein the heating sections are arranged in parallel, concentric, zig-zag-meandering or spiral shapes in the direction in which the heating sections run.

7. A heating element according to claim 1 wherein at least one heating section includes a plurality of bends forming said plurality of junction points.

8. A heating element according to claim 7 wherein the junction points are distributed over substantially an entire length of the bundle, and at least in front of and behind a stitching seam crossing the heating bundle.

9. A heating element according to claim 1 wherein each bundle has a height equal to an overall height of three heating sections.

10. A heating element according to claim 1 wherein at least two heating sections of each bundle comprise a different material.

11. A heating element according to claim 1 comprising a carrier layer with at least one of said bundles attached to the carrier layer.

12. A heating element according to claim 11 wherein at least one electrode is attached to said carrier layer.

13. A heating element according to claim 1 wherein at least one of said bundles is disposed between a carrier layer and a cover layer.

14. A heating element comprising:

at least two electrodes, and at least two bundles of heating sections, each bundle being electrically connected between two of said electrodes, wherein adjacent bundles are arranged at a distance from each other so as to avoid electrical contact, wherein each bundle comprises a plurality of heating sections arranged on at least a portion of a base surface to be heated;

wherein the heating element is at least partially overstitched by a stitching seam, the stitching seam crossing at least one bundle of heating sections at an angle ($\alpha$), wherein through-points of the stitches of the stitching seam define an opening size (d) and gaps (x) from adjacent through-points, the bundles having a width (b) crossways to its longitudinal extension and in the plane of the base surface to be heated, and at least one heating section of the bundle having a width (f) crossways to its longitudinal extension and in the plane of the base surface to be heated, wherein the opening size (d) is less than the bundle width (b).

15. A heating element according to claim 14 wherein the opening size (d) is smaller than the bundle width (b) by at least the heating section width (f).

16. A heating element according to claim 15 wherein the gaps (x) are at least as great as the bundle width (b).

17. A vehicle seat cushion comprising:

a core pad;

a flexible heating element comprising: at least two electrodes, and at least two bundles of heating sections, each bundle being electrically connected between two of said electrodes, wherein adjacent bundles are arranged at a distance from each other so as to avoid electrical contact, wherein each bundle comprises a plurality of heating sections arranged on at least a portion of the core pad; and a seat cover overlaying the heating element and coupling the heating element to the core pad wherein at least two heating sections of at least one bundle are spaced apart from one another for substantially a majority of their course, and at least one heating section forms a plurality of junction points with at least one other heating section.

18. A vehicle seat cushion according to claim 17 wherein each bundle comprises at least three heating sections, the heating sections being arranged in parallel, concentric, zigzag-meandering or spiral shapes in the direction in which the heating sections run.

19. A vehicle seat cushion according to claim 18 wherein at least one heating section includes a plurality of bends.

20. A vehicle seat cushion according to claim 19 wherein the junction points are distributed over substantially an entire length of the bundle, and at least in front of and behind a stitching seam crossing the heating bundle.

21. A heating element comprising:

at least two electrodes, and at least two bundles of heating sections, each bundle being electrically connected between two of said electrodes, wherein adjacent bundles are arranged at a distance from each other so as to avoid electrical contact, wherein each bundle comprises a plurality of heating sections arranged on at least a portion of a base surface to be heated;

wherein the heating element is at least partially overstitched by a stitching seam, the stitching seam crossing at least one bundle of heating sections at an angle ($\alpha$), wherein through-points of the stitches of the stitching seam define an opening size (d) and gaps (x) from adjacent through-points, the bundles having a width (b) crossways to its longitudinal extension and in the plane of the base surface to be heated, and at least one heating section of the bundle having a width (f) crossways to its longitudinal extension and in the plane of the base surface to be heated, wherein the gaps (x) are greater than or equal to the heating section width (f).

* * * * *